US009050494B2

(12) United States Patent
Bass et al.

(10) Patent No.: US 9,050,494 B2
(45) Date of Patent: Jun. 9, 2015

(54) CONTROLLED PRESSURE RESISTANCE UNIT ENGAGEMENT SYSTEM

(71) Applicant: Saris Cycling Group, Inc., Madison, WI (US)

(72) Inventors: Benjamin R. Bass, Madison, WI (US); Mark A. Dahl, Madison, WI (US); Randy J. Hilgart, Cottage Grove, WI (US)

(73) Assignee: Saris Cycling Group, Inc., Madison, WI (US)

( * ) Notice: Subject to any disclaimer, the term of this patent is extended or adjusted under 35 U.S.C. 154(b) by 84 days.

(21) Appl. No.: 13/790,950

(22) Filed: Mar. 8, 2013

(65) Prior Publication Data

US 2013/0237387 A1 Sep. 12, 2013

Related U.S. Application Data

(60) Provisional application No. 61/608,749, filed on Mar. 9, 2012, provisional application No. 61/650,203, filed on May 22, 2012.

(51) Int. Cl.

| | |
|---|---|
| ***A63B 69/16*** | (2006.01) |
| ***A63B 22/06*** | (2006.01) |
| ***A63B 21/012*** | (2006.01) |

(52) U.S. Cl.

CPC ..... *A63B 22/0605* (2013.01); *A63B 69/16* (2013.01); *A63B 21/0125* (2013.01); *A63B 2069/165* (2013.01)

(58) Field of Classification Search

CPC .... A63B 22/00; A63B 22/06; A63B 22/0605; A63B 22/08

USPC ..... 482/51, 57, 58–65

See application file for complete search history.

(56) References Cited

U.S. PATENT DOCUMENTS

| | | | | |
|---|---|---|---|---|
| 3,724,844 | A | 4/1973 | Olmstead et al. | |
| 5,110,003 | A * | 5/1992 | MacWilliams | 220/304 |
| 5,468,201 | A * | 11/1995 | Minoura | 482/61 |
| 5,728,029 | A | 3/1998 | Minoura | |
| 5,944,637 | A | 8/1999 | Stickler et al. | |
| 6,042,517 | A * | 3/2000 | Gunther et al. | 482/57 |
| 6,070,774 | A * | 6/2000 | Rak et al. | 224/321 |
| 6,162,152 | A | 12/2000 | Kuo | |
| 6,238,155 | B1 * | 5/2001 | Aukzemas et al. | 411/107 |
| 6,488,611 | B1 | 12/2002 | Ambrosina et al. | |
| 6,527,681 | B2 | 3/2003 | Tacx | |
| 6,620,081 | B2 | 9/2003 | Phillips | |
| 6,702,721 | B2 | 3/2004 | Schroeder | |
| 6,843,758 | B2 | 1/2005 | Qiu | |
| 6,964,633 | B2 * | 11/2005 | Kolda et al. | 482/63 |
| 7,011,607 | B2 * | 3/2006 | Kolda et al. | 482/57 |
| 7,727,124 | B1 * | 6/2010 | Lassanske et al. | 482/61 |
| 2004/0106505 | A1 | 6/2004 | Qiu | |
| 2009/0075785 | A1 | 3/2009 | Schroeder | |

FOREIGN PATENT DOCUMENTS

| | | | |
|---|---|---|---|
| EP | 1132118 | A2 | 9/2001 |
| EP | 1331023 | A2 | 7/2003 |

* cited by examiner

*Primary Examiner* — Stephen Crow
*Assistant Examiner* — Garrett Atkinson
(74) *Attorney, Agent, or Firm* — Boyle Fredrickson, S.C.

(57) ABSTRACT

A controlled pressure resistance unit engagement system for bicycle training devices uses a clutch arrangement to limit the maximum torque applied. By doing so, a consistent, correct pressure on a bicycle tire by the resistance unit is achieved, thereby avoiding damage to the resistance unit and the bicycle tire and allowing a more consistent resistance unit power curve to be achieved.

15 Claims, 18 Drawing Sheets

CONTROLLED PRESSURE RESISTANCE UNIT ENGAGEMENT SYSTEM

CROSS-REFERENCE TO RELATED APPLICATIONS

This application claims priority to U.S. Provisional Patent Application Nos. 61/608,749 filed on Mar. 9, 2012 and 61/650,203 filed on May 22, 2012 each entitled Controlled Pressure Resistance Unit Engagement System, the entireties of which are expressly incorporated by reference herein.

FIELD OF THE INVENTION

The present invention relates to the field of exercise devices. More particularly, the present invention relates to a controlled pressure resistance unit engagement system that, when used, applies a consistent, correct pressure of a resistance unit on the wheel of a bicycle.

BACKGROUND OF THE INVENTION

A number of resistance-type bicycle training devices have been developed that allow a person to train on a bicycle while maintaining a stationary position. Such bicycle training devices are commonly used indoors when it is not possible or convenient to ride outdoors. Such bicycle training devices normally include a collapsible frame that may be positioned on the floor and releasably attachable to the rear wheel of the bicycle. The frame supports a resistance unit, which is known to include a mounting member, a roller rotatably secured to the mounting member, and a knob for tightening the roller. The resistance unit releasably engages the bicycle tire by application of pressure against the rear wheel, via the roller, to provide resistance to the rotation of the wheel. Therefore, as the person moves the pedals and, consequently, the rear wheel of the bicycle, the rotation of the wheel is opposed by the resistance provided by the resistance unit.

Previous resistance unit engagement mechanisms, which typically utilize a screw-type knob for resistance unit engagement, have not provided feedback on how tight to turn the knob to provide a desired degree of pressure. The result is the inability to apply consistent, correct pressure of the resistance unit against the wheel of the bicycle. For example, some users may not tighten the roller of the resistance unit against the tire enough (under tighten), which can cause slippage between the tire and the resistance unit. On the other hand, some users may tighten the roller of the resistance unit against the tire too much (over tighten), which can cause a significant increase in resistance. In either event, variance in resistance unit pressure and resultant resistance to wheel rotation may lead to an undesirable user experience, and over tightening can cause premature tire wear and/or damage to the roller.

Also, because consistency in pressure with previous knobs was only achievable through user feel, design efforts directed toward refining a specific power curve are typically ineffective or inaccurate due to the significant variance in the amount of torque that users may apply to the knob. The difference is especially noticeable with smaller diameter rollers in which one knob rotation could result in a significant difference in power attained by the resistance unit (e.g., one knob rotation could equal as much as 50 watts at 20 mph).

Needless to say, it is desirable to apply consistent, correct pressure of the resistance unit against the wheel of the bicycle during such training.

SUMMARY AND OBJECTS OF THE INVENTION

In accordance with an aspect of the present invention, a bicycle trainer is provided that includes a clutched adjuster arranged with respect to a resistance unit so that actuation of the clutched adjuster moves the resistance unit against a tire of a bicycle in the bicycle trainer so as to achieve an appropriate amount of tire-to-resistance unit engagement force and thus a correct amount of resistance. In this way, the bicycle can be mounted in the bicycle trainer multiple times for multiple training sessions and during each time the same amount of tire-to-resistance unit engagement force will be provided without requiring any tools or measurement instruments for setup comparisons. This may define a use-ready position of the resistance unit which provides a correct tire-to-resistance unit engagement force that can be consistently repeated in a tool-less manner.

In accordance with another aspect of the present invention, the clutched adjuster may be a rotatable member such as a knob or a pivoting member such as a lever. A clutch arrangement may be arranged at least partially within the knob or lever so that the knob or lever can be manipulated to a maximum tightened position, after which further manipulation results in the clutch arrangement slipping to prevent over tightening. This may allow for consistent set-up(s) of the bicycle trainer by tightening the clutched adjuster until the clutch slips at the maximum tightened position, which provides the correct tire-to-resistance unit engagement force.

According to another aspect of the present invention, a clutch arrangement is used to limit the maximum torque applied to the knob, and by doing so, also applies consistent pressure to the tire through the resistance unit. By providing users with a clutched knob, each user can apply consistent, correct torque. This will prevent a user from under tightening or over tightening the resistance unit, thereby avoiding tire or resistance unit damage. Also, by applying consistent pressure, a more consistent resistance unit power curve can be achieved.

According to yet another aspect of the present invention, a clutch arrangement is used in a clutch lever arrangement for a bicycle trainer to limit the maximum torque for a predetermined pressure of a movable resistance unit of the bicycle trainer on a bicycle tire. The resistance unit may include a roller for engaging the bicycle tire. The roller may be supported by a body having an opening or cavity with a boundary defined by an interior ribbed surface of a portion of the resistance unit body. A ribbed cam may be arranged within the cavity and have an exterior ribbed surface operable to engage the interior ribbed surface of the resistance unit body. The ribbed cam may include a detent that operably engages a cantilevered finger of the pivoting member so that a clutch arrangement is defined at least in part by the cantilevered finger and the detent. Pivoting of the pivoting member in a first direction provides movement of the ribbed cam and the engaged resistance unit toward a bicycle tire for tightening the resistance unit against the bicycle tire until the clutch arrangement enables the cantilevered finger to move past the detent at a maximum torque for a predetermined pressure of the resistance unit on the bicycle tire. At this point, the pivoting member is cam-locked into a locked position at which the resistance unit is maintained in the use-ready position for applying a correct pressure of engagement of the resistance unit with the tire. Pivoting of the pivoting member in a second direction provides movement of the ribbed cam and the engaged resistance unit away from the bicycle tire. By providing users with a clutched lever, each user can apply consistent, correct torque. This will prevent users from under tightening or over tightening their resistance units, thereby avoiding tire or resistance unit damage. Also, by applying consistent pressure, a more consistent resistance unit power curve can be achieved.

These and other aspects and objects of the present invention will be better appreciated and understood when considered in conjunction with the following description and the accompanying drawings. It should be understood, however, that the following description, while indicating preferred embodiments of the present invention, is given by way of illustration and not by way of limitation. Many changes and modifications may be made within the scope of the present invention without departing from the spirit thereof, and the invention includes all such modifications.

BRIEF DESCRIPTION OF THE DRAWINGS

The drawings illustrate the best mode presently contemplated of carrying out the invention.

In the Drawings.

Figure 1:
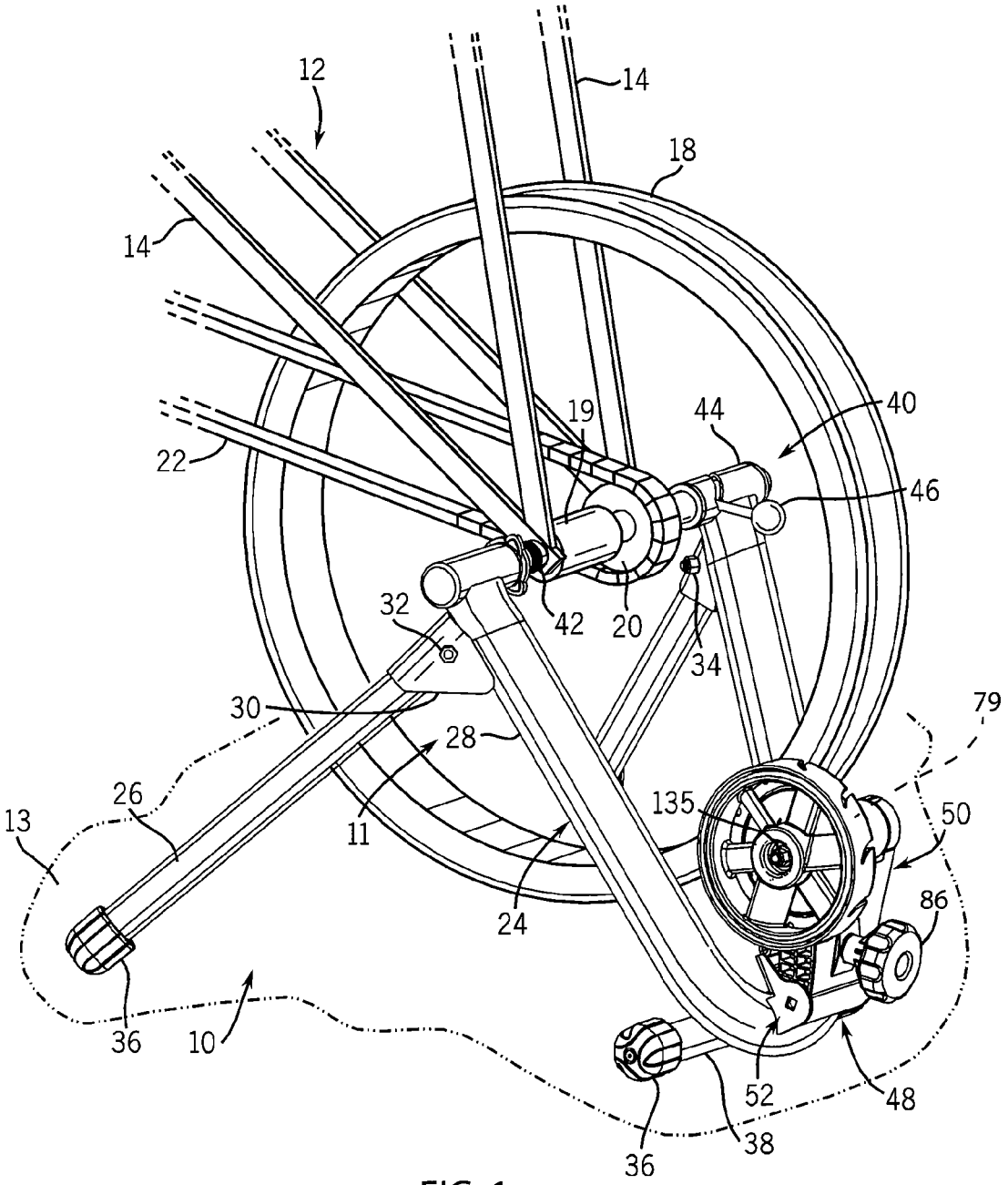
FIG. 1 is an isometric view of a bicycle trainer in accordance with the present invention.

In describing the illustrated embodiment of the invention as shown in the drawings, specific terminology will be resorted to for the sake of clarity. However, it is not intended that the invention be limited to the specific terms so selected, and it is to be understood that each specific term includes all technical equivalents which operate in a similar manner to accomplish a similar purpose. For example, the word coupled, connected, attached, or terms similar thereto are often used. They are not limited to direct connection but include connection through other elements where such connection is recognized as being equivalent by those skilled in the art.

DETAILED DESCRIPTION

Figure 2:
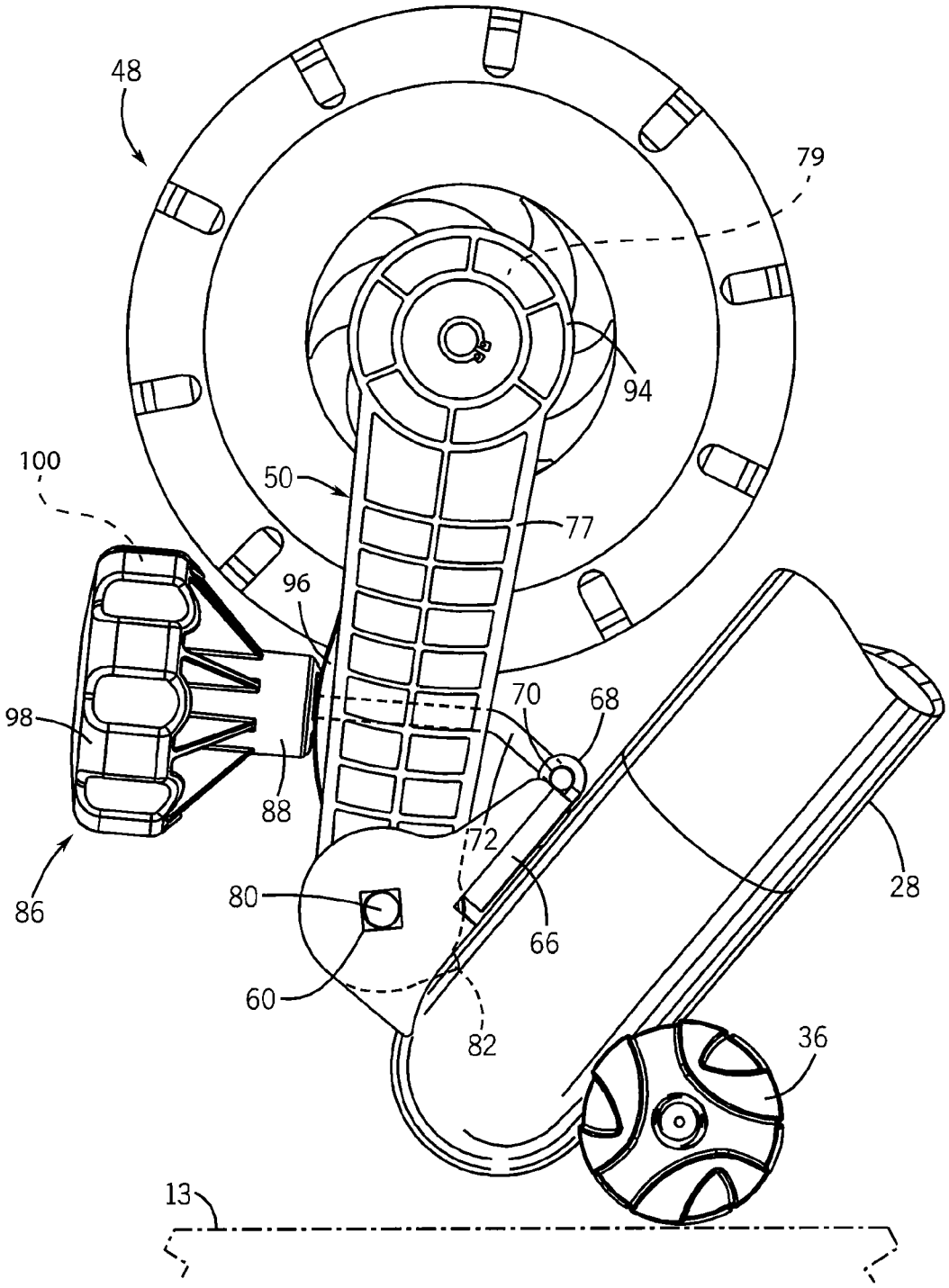
FIG. 2 is a partial side elevation view of the resistance unit of the bicycle trainer of FIG. 1.

The present invention and the various features and advantageous details thereof are explained more fully with reference to the non-limiting embodiments described in detail in the following description. Referring now to FIGS. 1-2, a bicycle training device is indicated generally at 10. The device 10 includes a frame 11 that is adapted to releasably support a bicycle 12. The frame 11 rests on a horizontal surface 13 and can be a frame similar to that which is incorporated in any conventional bicycle trainer and which is capable of releasably engaging either the frame or a rear wheel of a bicycle, such as is incorporated into trainers manufactured by the Cycle-Ops division of Saris Cycling Group, Inc. of Madison, Wis. Bicycle 12 includes downwardly extending frame members or stays 14 that support the hub 19 of a wheel 18 associated with bicycle 12. Hub 19 carries a sprocket 20 driven by a chain 22 in response to a conventional pedal and crank assembly associated with bicycle 10, in a manner as is known.

The frame 11 has a pair of generally forwardly extending legs 26 attached to opposite ends of a generally U-shaped support member 28. The legs 26 also extend slightly outwardly with respect to the support member 28 to enhance the stability of the device 10. The legs 26 and support member 28 are formed of a generally rigid material, such as a metal tubing, which may have a circular or any other desired cross section. Each of the legs 26 is connected to the support member 28 by a brace 30 that is secured to support member 28. A bolt 32 extends through the leg 26 and brace 30, and a nut 34 is engaged with the threads of bolt 32 such that leg 26 is pivotable about bolt 32 between an extended position as shown and a folded position for storage. Opposite the brace 30, each leg 26 also includes a foot 36 formed of a resilient high friction material, such as rubber, that serves to prevent the leg 26 from slipping with respect to the surface 13 on which the frame 11 is positioned. The support member 28 also includes a pair of feet 36 attached to opposite ends of a horizontal cross member 38 secured to the support member 28 opposite the legs 26. The cross member 38 serves to assist the legs 26 in holding the device 10 stable and stationary on the horizontal surface 13.

Training device 10 includes a releasable engagement mechanism 40 having a stationary first portion 42 located on one side of frame 11, and a movable second portion 44 having a manual release lever 46 located on the other side of frame 11. In a known manner, one end of the axle of hub 19 is engaged with stationary first portion 42, and lever 46 is operated to engage second portion 44 with the opposite end of the axle. In this manner, the rear of bicycle 12 is engaged with and supported by frame 11 such that rear wheel 18 is above the supporting surface 13, and can thus be rotated by operation of the pedals of bicycle 12.

A resistance unit 48 is movably mounted to frame 11 adjacent cross member 38. A clutched adjuster 49 in accordance with the present invention defines a driving engagement with the resistance unit 48 for moving the resistance unit 48 with respect to the wheel 18. The clutched adjuster 49 can be manipulated by a user to a maximum tightened position of the clutched adjuster 49 that corresponds to a maximum pressure between the resistance unit 48 and the wheel 18 which defines a use-ready position of the resistance unit 48. Manipulation beyond the maximum tightened position releases the driving engagement of the clutched adjuster 49 with the resistance unit 48 such that the clutched adjuster 49 cannot deliver more than a predetermined maximum torque, which prevents over tightening of the resistance unit 48 against the wheel 18. The clutched adjuster 49 may provide an indication, such as a tactile and/or audible indication, that the maximum tightened position has been achieved, as described in greater detail elsewhere herein.

A support yoke or arm 50 supports the resistance unit 48 and is pivotally attached to the support member 28 between a pair of mounting members 52. Each mounting member 52 is fixed to the support member 28, and functions to hold the resistance unit 48 on the support member 28. Each mounting member 52 includes an opening 60, and a pivot plate 66 extends between mounting members 52. The pivot plate 66 includes an upwardly curved section 68 that extends outwardly and defines a sleeve 70, which pivotally retains one end of an adjustment rod 72 that is used to adjust the position of the support arm 50 with respect to the support member 28.

Referring now to FIG. 2, the support arm 50 includes a first cylindrical end and a second cylindrical end joined by a generally rectangular intermediate section 77. The first cylindrical end defines a channel extending therethrough that is alignable with the opening 60 in each of the mounting members 52. When the channel is aligned with the openings 60, a first shaft 80 can be inserted therethrough to pivotally secure the first end 74 and support arm 50 to the mounting members 52.

The generally rectangular intermediate section 77 increases in width as it extends from the first end to the second end, but can also have a consistent width along its length. The intermediate section 77 includes a central slot extending through the central section perpendicularly to the channel in the first end. A threaded end (not shown) of the adjustment rod 72 opposite the sleeve 70 on plate 66 is inserted through the slot and, in this embodiment, is threadedly engaged with the clutched adjuster 49 that includes a rotatable member, shown here as knob 86. The knob 86 includes a lower assembly 88 with which the adjustment rod 72 is threadedly engaged with a nut 90 that is captured against rotation within a stem 92 that extends from an intermediate portion of a plate 95 (FIG. 4)., The lower assembly 88 may rest against a pair of curved surfaces 96 extending outwardly from the intermediate section 77 on opposite sides of the slot in order to limit the pivoting of the support arm 50 away from the support member 28 (FIG. 2).

An upper assembly 98 of the knob 86 engages and selectively transmits torque to the lower assembly 88 through a clutch arrangement 100 for moving the resistance unit 48, as long as a user-applied input torque does not exceed a maximum torque value, as explained in greater detail elsewhere herein. In this way, during a tightening procedure by rotating knob 86, the position of lower assembly 88 on adjustment rod 72 or the rod 72 with respect to other components of the resistance unit 48 can be adjusted to selectively adjust the angle of support arm 50 with respect to the support member 28. This allows the resistance unit 48 to be adjusted with respect to the support member 28 in order to accommodate wheels 18 having different diameters and to tighten the resistance unit 48 against the wheel 18.

Still referring to FIG. 2, the second cylindrical end of support arm 50 is formed by a pair of generally circular flanges 94 extending outwardly from the intermediate section 77 opposite the first end. Each of the circular flanges 94 is integrally formed with the intermediate section 77 and includes a central opening extending axially therethrough. A roller 79 engages and is rotated by the wheel 18. The roller 79 is positioned between the flanges 94 and includes a passage within which a shaft is located. The roller may have generally the same diameter as flanges 94, although it is understood that the roller 79 may have a diameter either greater or less than that of flanges 94. The roller shaft is supported by bearings mounted to flanges 94, and extends through the central openings in order to rotatably support the roller between the flanges 94. The roller shaft is fixed to the roller such that the shaft and roller rotate together. The roller shaft extends outwardly from one of the flanges 94. The roller shaft can be fixed in position between the flanges 94 to retain the roller rotatably between the flanges 94, by means of a snap ring or other suitable engagement member secured to the roller shaft.

Figure 3:
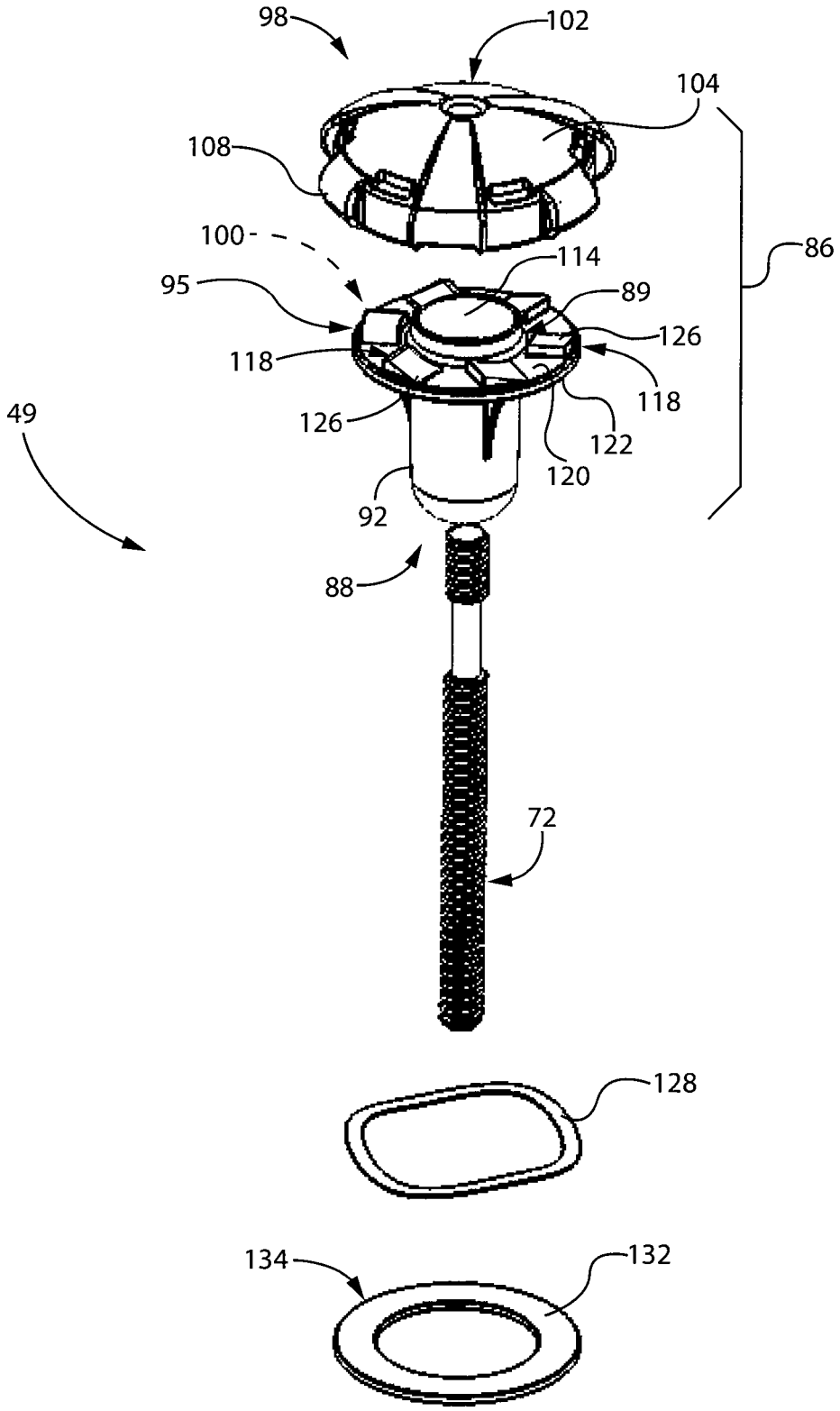
FIG. 3 is an exploded isometric view from above of a clutched adjuster incorporated in the bicycle trainer of FIG. 1
Figure 4:
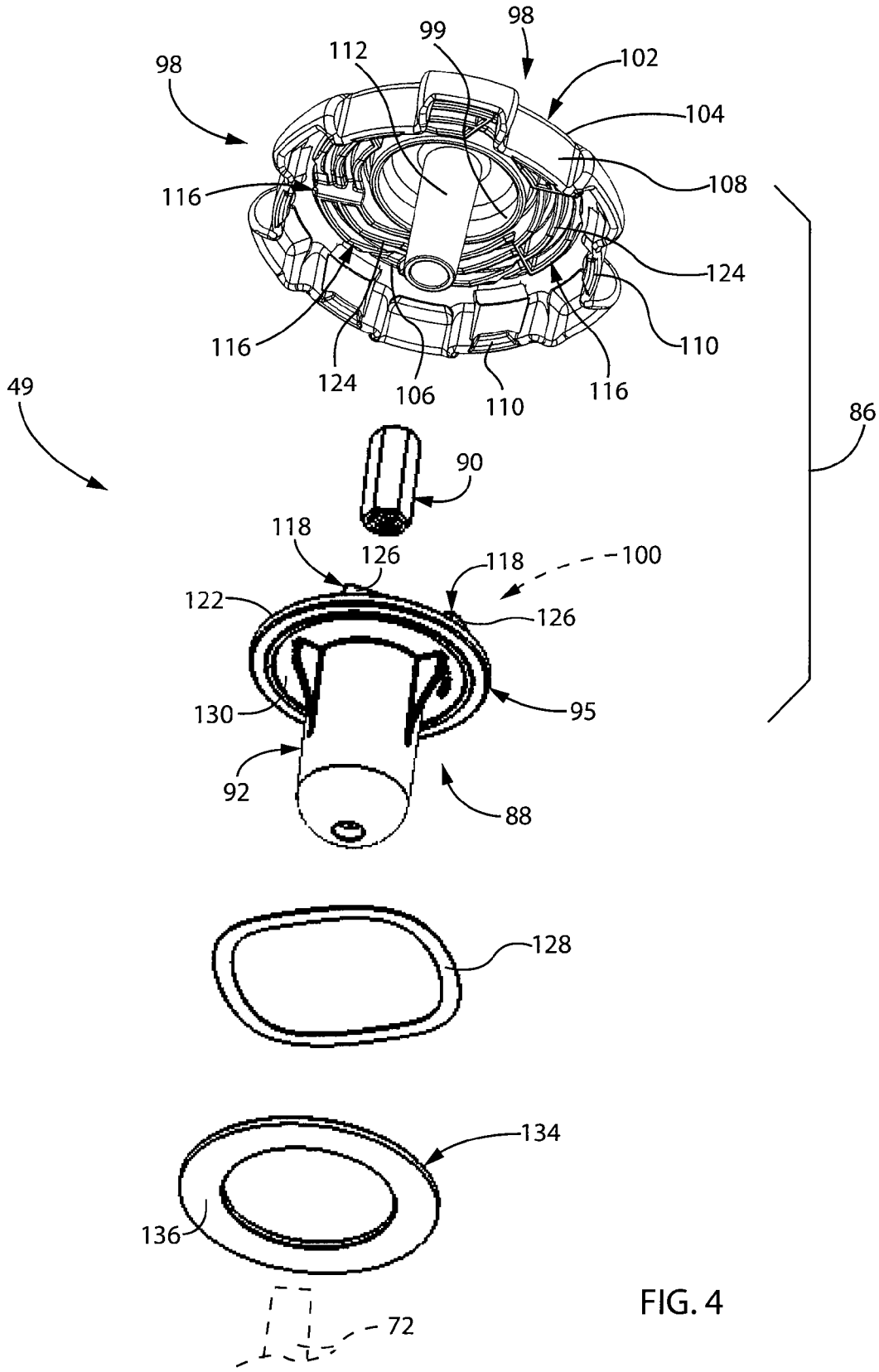
FIG. 4 is an exploded isometric view from below of the clutched adjuster of FIG. 3.
Figure 5:
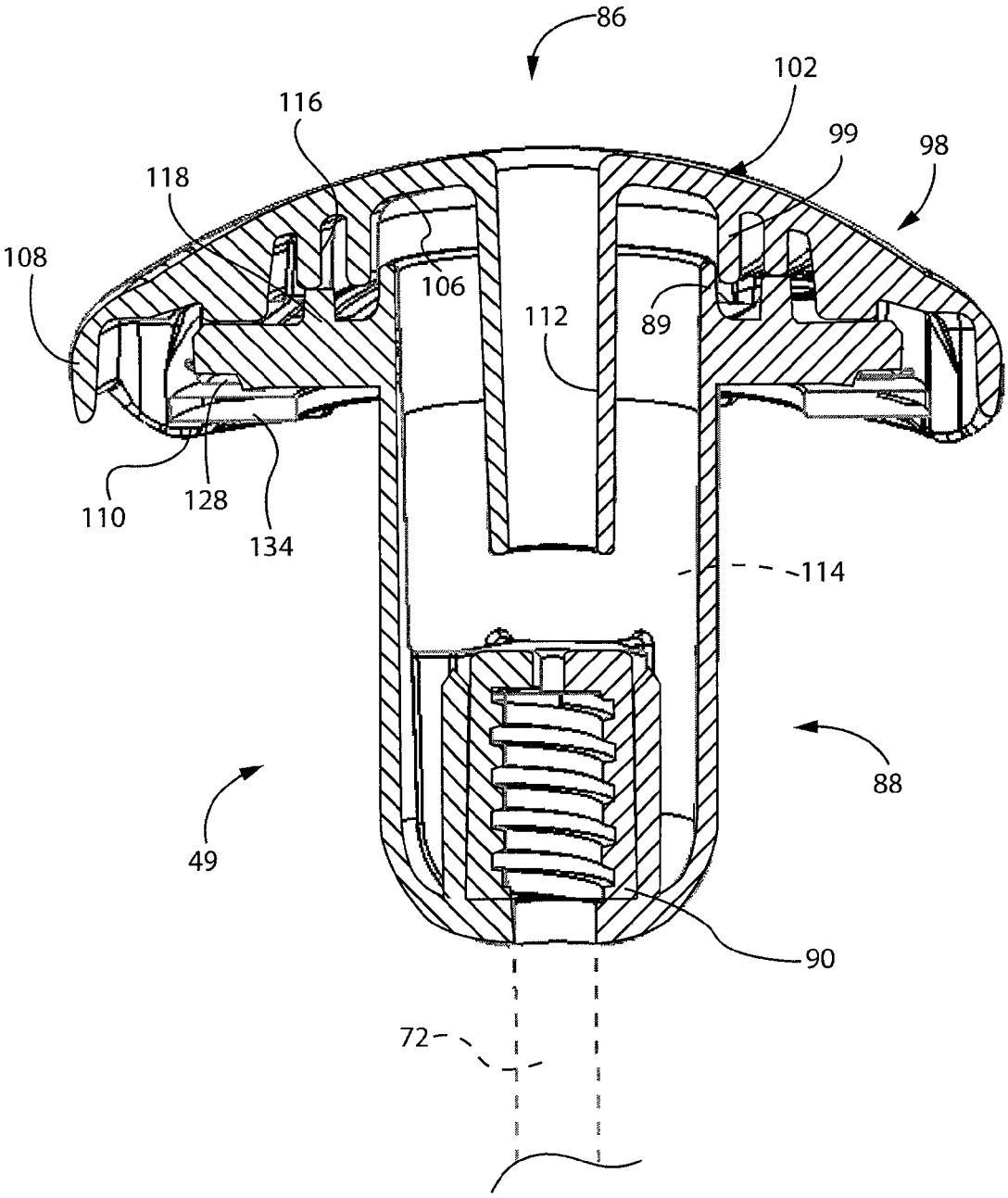
FIG. 5 is a cross-sectional view of the clutched adjuster of FIG. 3.

Referring now to FIGS. 3 and 4, in this embodiment, the upper assembly 98 includes a cap 102 having an upper wall 104 that defines a lower surface 106 (FIG. 4) and a side wall 108 extending downwardly away from an outer periphery of the upper wall 104. Tabs 110 extend inwardly from an inner surface of the side wall 108. Referring now to FIG. 4, a cap stem 112 that is longitudinally aligned with the nut 90 extends downwardly from a central portion of the upper wall 104 and is received in and is arranged to rotate and axially slide with respect to a bore 114 of stem 92 of the lower assembly 88 (FIG. 3). Referring now to FIG. 5, collars 99 and 89 extend from the upper and lower assemblies 98, 88, respectively. The collars 99, 89 are arranged with respect to each other to maintain axial registration of the upper and lower assemblies 98, 88 while permitting both rotational and axial movement of the upper and lower assemblies 98, 88 with respect to each other. As shown in this embodiment, collar 99 may extend from the lower surface 106 of the upper wall 104 of cap 102, toward the plate 95 of the lower assembly 88. Collar 99 is shown as concentrically surrounding collar 89 that extends from the plate 95, toward the upper assembly 98. Referring again to FIG. 4, upper assembly ramps 116 extend downwardly from the lower surface 106 of the upper wall 104. The upper assembly ramps 116 are arranged between the side wall 108 and the cap stem 112.

Referring now to FIG. 3, lower assembly ramps 118 extend from an upper surface 120 of the plate 95 of the lower assembly 88. The lower assembly ramps 118 are arranged between an outer edge 122 and the bore 114 of the plate 95. Referring again to FIGS. 3 and 4, the upper and lower assembly ramps 116, 118 define angled surfaces 124, 126, respectively. Referring again to FIGS. 3 and 4, the angled surfaces 124, 126 are urged against each other by a biasing force provided by a spring 128. In this embodiment, the spring 128 is a wave-type spring, although it is understood that other suitable springs may be used. Spring 128 is sandwiched in a compressed state between a lower surface 130 (FIG. 4) of the plate 95 and an upper surface 132 (FIG. 3) of a washer 134. Referring again to FIG. 4, the tabs 110 extending from the side wall 108 of the cap 102 engage a lower surface 136 of the washer 134 to retain the washer 134 within the cap 102 which holds the spring 128 in a compressed state and urges the angled surfaces 124, 126 against each other.

In the complete assemblage of the knob 86, the engaged angled surfaces 124, 126 define a friction-based driving interface between the upper and lower assemblies 98, 88 that at least partially defines a clutch arrangement 100. When a user inputs a torque to the knob 86 by rotating the cap 102, if the input torque is at or less than a maximum torque value, then rotation of the cap 102 is translated through the frictional engagement of the angled surfaces 124, 126 of the upper and lower assembly ramps 116, 118, respectively, into rotation of the lower assembly 88. This correspondingly rotates the rod 72 which moves the resistance unit 48 closer to the wheel 18 so as to tighten the resistance unit 48 against the wheel 18 (FIG. 1). While rotating the knob 86, the resistance unit 48 is progressively tightened against the wheel 18 until a maximum pressure between the resistance unit 48 and the wheel 18 is achieved. This defines a use-ready position of the resistance unit 48 and a maximum tightened position of the clutched adjuster 49. An attempted over-tightening procedure to try to push the resistance unit 48 even more tightly against the wheel 18 by moving the clutched adjuster 49 beyond the maximum tightened position causes a slip in the clutch arrangement 100 which uncouples the driving engagement between the upper and lower assemblies 98, 88 of the knob 86, such that the resistance unit 48 remains in the use-ready position without being over tightened. That is because the inputted torque during an attempted over-tightening procedure overcomes the holding power between the upper and lower assembly ramps 116, 118 by exceeding the frictional engagement between the angled surfaces 124, 126 provided by spring 128. When this happens, the force of spring 128 is overcome and the upper assembly ramps 116 slide up and over the lower assembly ramps 118 in a ratchet-type manner, so that the upper assembly 98 rotates with respect to the lower assembly 88 without translating rotational motion to the lower assembly 88 or the rod 72, whereby the resistance unit 48 does not move. Sliding of the upper assembly ramps 116 over the lower assembly ramps 118 may provide an indication that can be perceived by the user that the maximum tightened position of the knob 86 has been achieved, which indicates that the resistance unit 48 is in the use-ready position and is properly tightened against the wheel 18. The indication may be audible, such as a click sound that may be emitted as the upper assembly ramps 116 fall off from the lower assembly ramps 118, or may be tactile, such as feeling the associated click. Furthermore, a tactile indication may be provided by the feeling of the release of turning resistance when the clutch arrangement 100 slips or the feeling of the upper assembly 98 moving axially away from the lower assembly 88 while the upper assembly ramps 116 climb upwardly with respect to the lower assembly ramps 118, which wedges the upper and lower assemblies 98, 88 away from each other and further compresses the spring 128. An axial movement of the upper assembly 98 away from the lower assembly 88 is schematically represented by the dashed arrows on opposing sides of the upper assembly 98 in FIG. 5. When the upper assembly ramps 116 clear the lower assembly ramps 128, the spring 128 returns the angled surfaces 124, 126 into engagement with each other. When knob 86 is turned the opposite direction to move the resistance unit 48 away from the wheel, the faces of the ramps 124, 126 engage each other so that rotation of knob 86 is transferred directly to rod 72 so as to turn rod 72 in a loosening direction.

Figure 6:
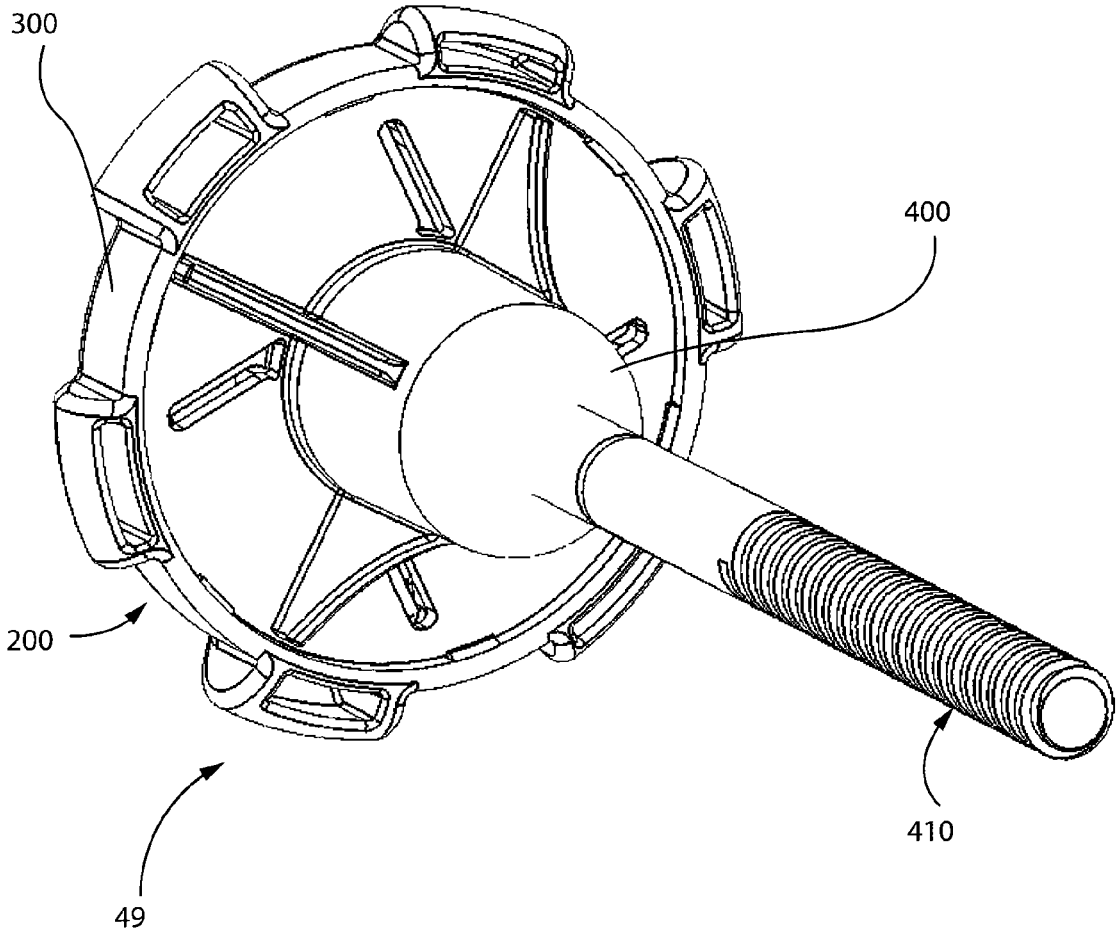
FIG. 6 is an isometric view of a variant of a clutched adjuster in accordance with the present invention.

Referring now to FIG. 6, in this embodiment, the clutched adjuster 49 defines a rotatable member shown in this embodiment as a knob 200 for a controlled pressure resistance unit which is shown having a first or upper assembly 300 coupled to a second or lower assembly 400. The upper assembly 300 is ordinarily accessible by a user for turning, unless, for example, turning is performed by an automated function. The upper assembly 300 may include grips, ergonomic by shape or material, to better facilitate turning. The lower assembly 400 includes a threaded rod 410 (analogous to adjustment rod 72 discussed above) extending longitudinally outward for interfacing with a non-rotating but pivotally mounted nut attached to the frame. The threads on threaded rod 410 may be Acme threading, standard threading, or any other type of threading as is commonly known in the art. The lower assembly 400 and threaded rod 410 rotate together in one direction to tighten, or in another direction to loosen, the resistance unit relative to the bicycle tire.

Figure 7:
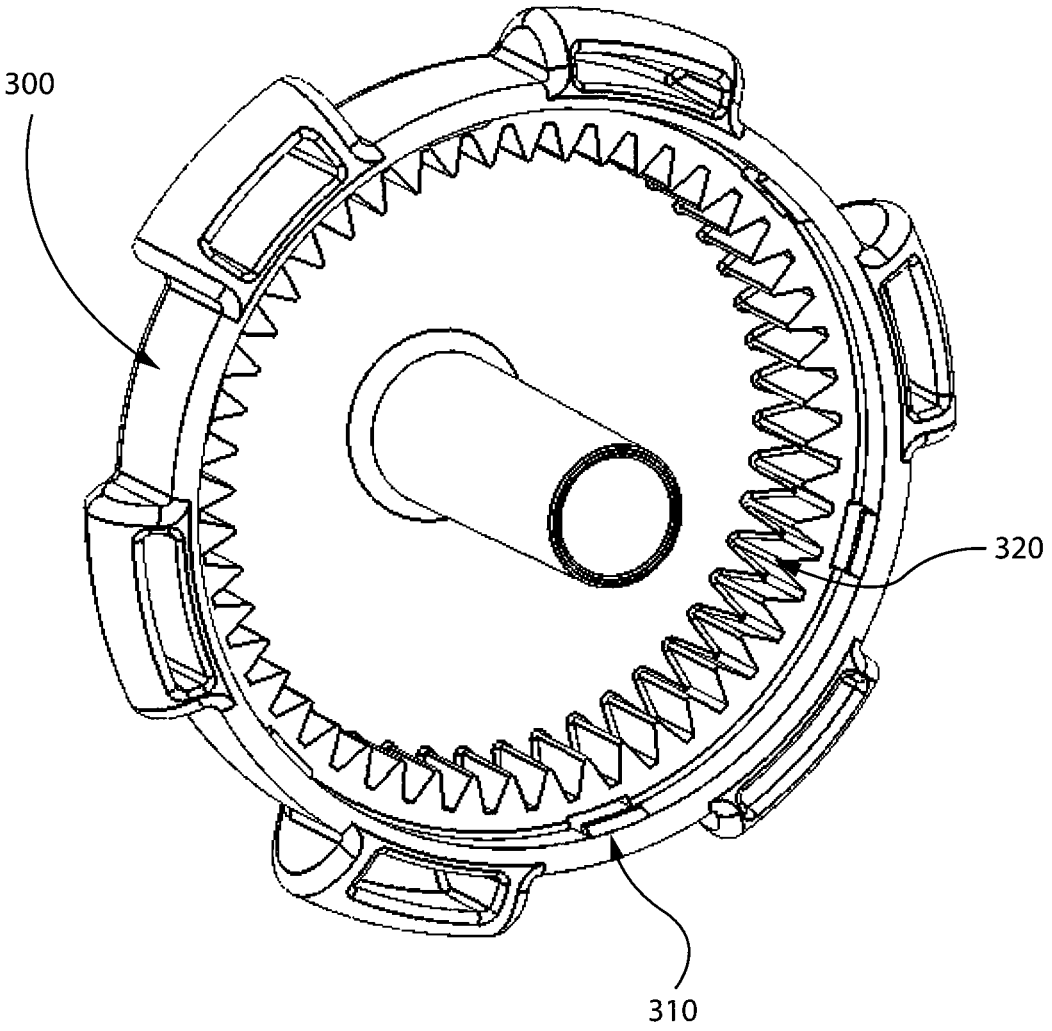
FIG. 7 is an isometric view of the upper assembly of the clutched adjuster of FIG. 6.

Referring now to FIG. 7, the upper assembly 300 is shown having a plurality of snaps 310 for engagement with a peripheral edge of the lower assembly 400, which serves to couple the upper assembly 300 to the lower assembly 400 while enabling relative rotation between upper assembly 300 and lower assembly 400. The upper assembly 300 is also shown having a rim defining a plurality of inwardly facing saw-toothed serrations or teeth 320 for cooperating with the lower assembly 400 to form a clutch arrangement.

Figure 8:
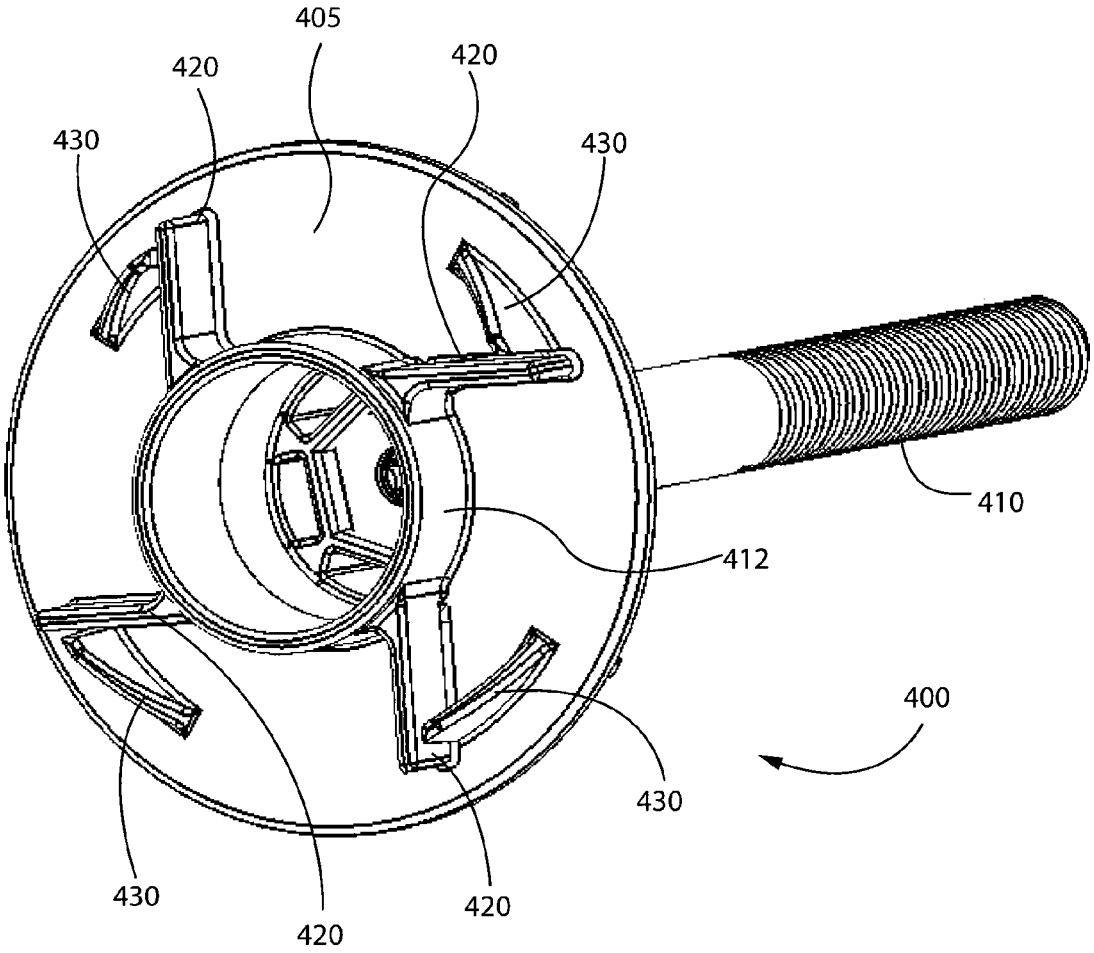
FIG. 8 is an isometric view of the lower assembly of the clutched adjuster of FIG. 6.

Referring now to FIG. 8, the lower assembly 400 is shown having a platform 405 extending outwardly from a central hub 412. The platform 405 defines the outer peripheral edge of lower assembly 400 which, as noted above, is engaged by the snaps 310 to rotatably secure upper assembly 300 and lower assembly 400 together. A plurality of spring arms 420 extends outwardly from hub 412, and cooperates with the teeth 320 of upper assembly 300 to form the clutch arrangement. The spring arms 420 may be formed integrally with the hub 412 of a material such as plastic, metal, or any other suitable material as is commonly known in the art. Alternatively, the spring arms 420 may be formed separately from the hub 412 and movably secured to the hub 412. Each spring arm 420 is connected to the hub 412 only at its inner end, such that the spring arms 420 are supported relative to hub 412 by a cantilever connection. The spring arms 420 are oriented non-radially relative to the center of hub 412. That is, each spring arm 420 is oriented at an acute angle relative to a radius extending from the center of hub 412 through the point at which the spring arm 420 is connected to the hub 412. The lower assembly 400 is also shown having a plurality of stops 430 for reinforcing the plurality of spring arms 420. Each stop 430 is generally in the shape of a ramp, terminating in an end that faces and is located closely adjacent to the surface of its associated spring arm 420. Each stop 430 is located toward the outer end of its associated spring arm 420.

Figure 9:
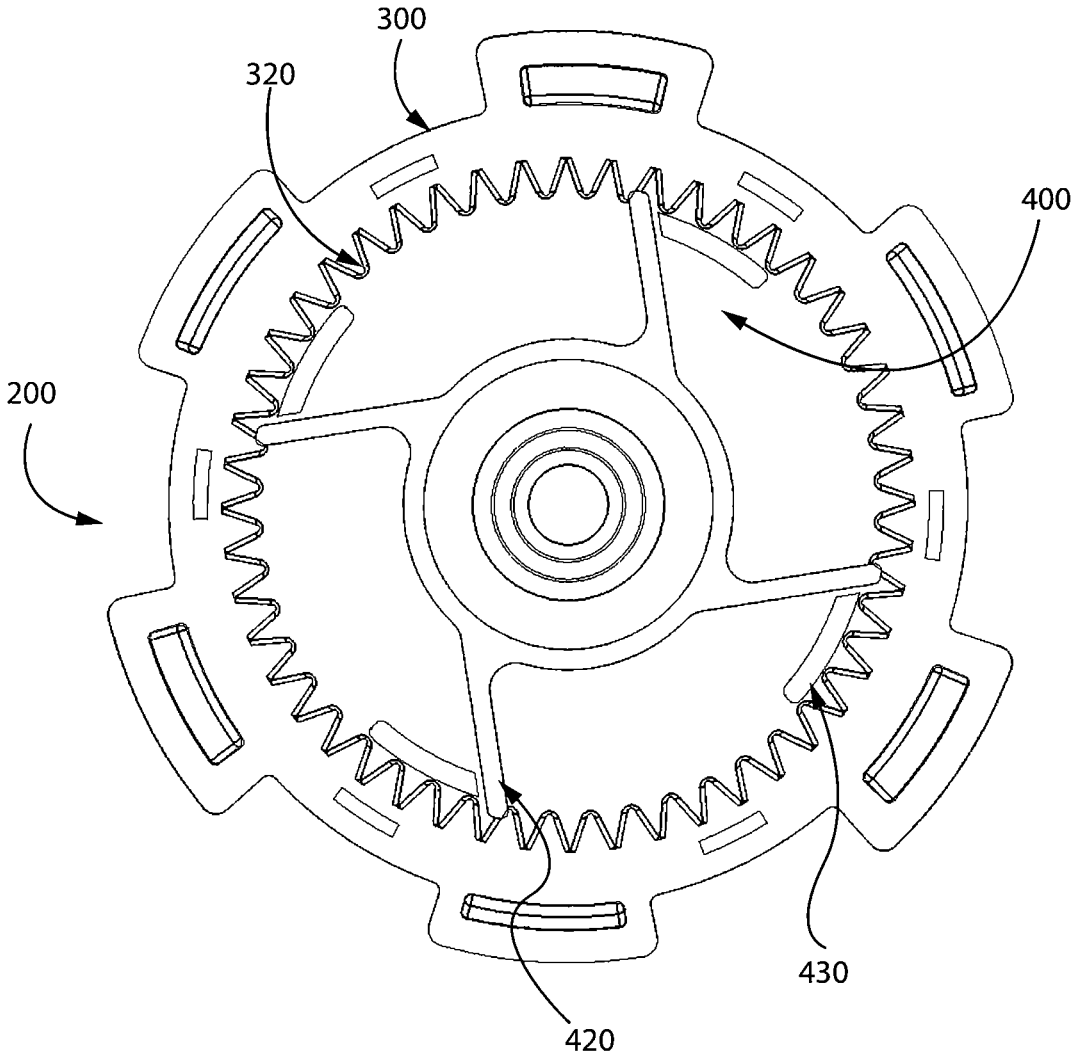
FIG. 9 is a top view looking internally into the clutched adjuster of FIG. 6.

FIG. 9 illustrates an end view of upper assembly 300 and lower assembly 400 secured together. As shown, spring arms 420 have a length that enables the end of each spring arm 420 to be engaged with the teeth 320 when the upper assembly 300 and the lower assembly 400 are secured together.

In operation, as the upper assembly 300 is turned in a tightening direction, torque is applied from the teeth 320 to spring arms 420, which in turn transfers torque from spring arms 420 to the lower assembly 400 and threaded rod 410, which in turn rotates the lower assembly 400 and threaded rod 410 to increasingly tighten the resistance unit against the bicycle tire. Once the roller of the resistance unit 48 engages the bicycle tire, continued rotation of knob 200 causes advancement of the roller a limited amount until a certain maximum torque is reached. When this occurs, the spring arms 420 flex and can no longer transfer torque to the lower assembly 400 and threaded rod 410. This causes the lower assembly 400 and threaded rod 410 to cease rotating, despite continued turning of the upper assembly 300 in a tightening direction. In other words, if the upper assembly 300 continues to turn in a tightening direction after a certain maximum torque is reached, the clutch arrangement functions as a ratchet mechanism that makes the upper assembly 300 slip past the lower assembly 400 without any further transfer of torque to the lower assembly 400, and thus no further tightening of the resistance unit 48 against the tire, whereby the resistance unit is maintained in the use-ready position without being over tightened. This occurs when the resistance unit 48 has attained an optimal desired position in engagement with the tire, and the slipping of the upper assembly 300 past the lower assembly 400 may provide an audible and/or tactile indication that the optimal desired position has been attained. It should be noted that the maximum amount of torque desired can be set, for example, according to the manufacture and the configuration of the spring arms. The user is now prevented from over tightening the resistance unit, thereby providing consistent resistance and avoiding tire damage.

When upper assembly 300 is turned in a loosening direction, torque is applied in the reverse direction from the teeth 320 to spring arms 420, which in turn causes spring arms 420 to flex in the opposite direction and engage stops 430. Once this occurs, rotation of upper assembly 300 is transferred to lower assembly 400 through engagement of spring arms 420 with stops 430, to thereby transfer torque in the reverse direction to threaded rod 410. Rotation of threaded rod 410, in turn, moves the resistance unit 48 away from the bicycle tire. The upper assembly 300 may be turned in a loosening direction to loosen the resistance unit clamp from the bicycle tire at any time, whether or not the maximum amount of torque has been reached and the clutch arrangement engaged.

Figure 10:
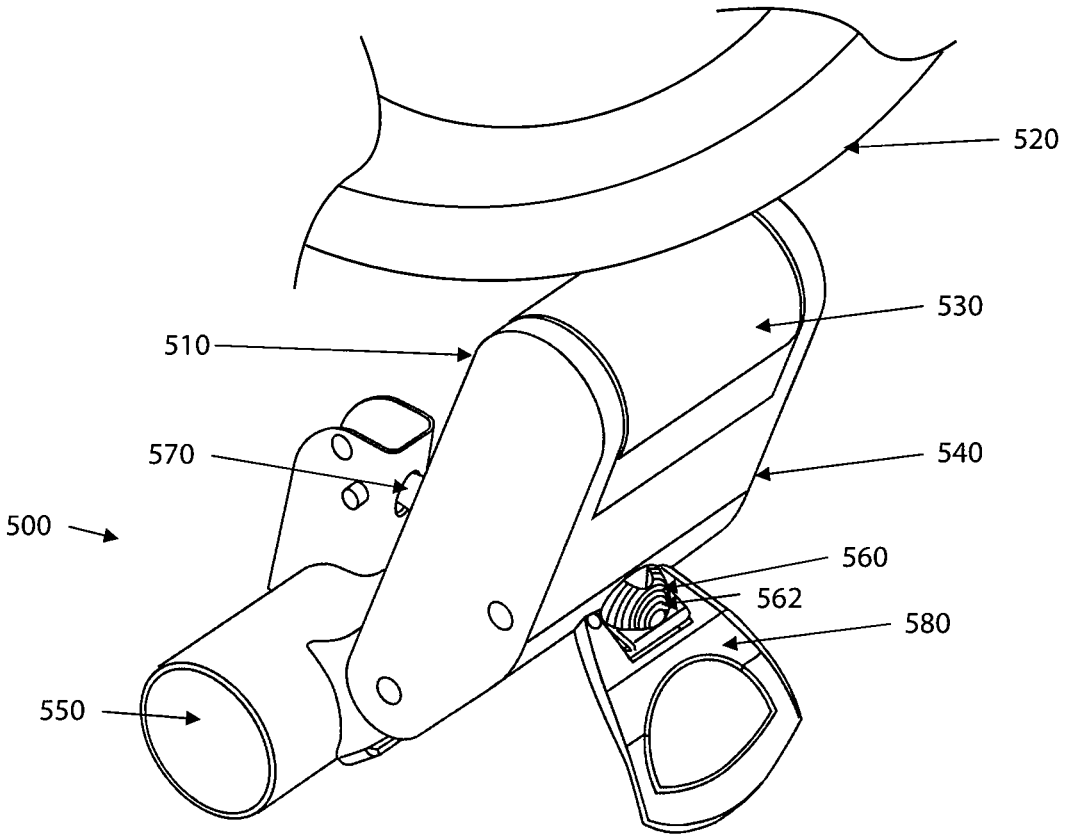
FIG. 10 is an isometric view of a resistance unit incorporating another variant of the clutched adjuster in accordance with the present invention.
Figure 11:
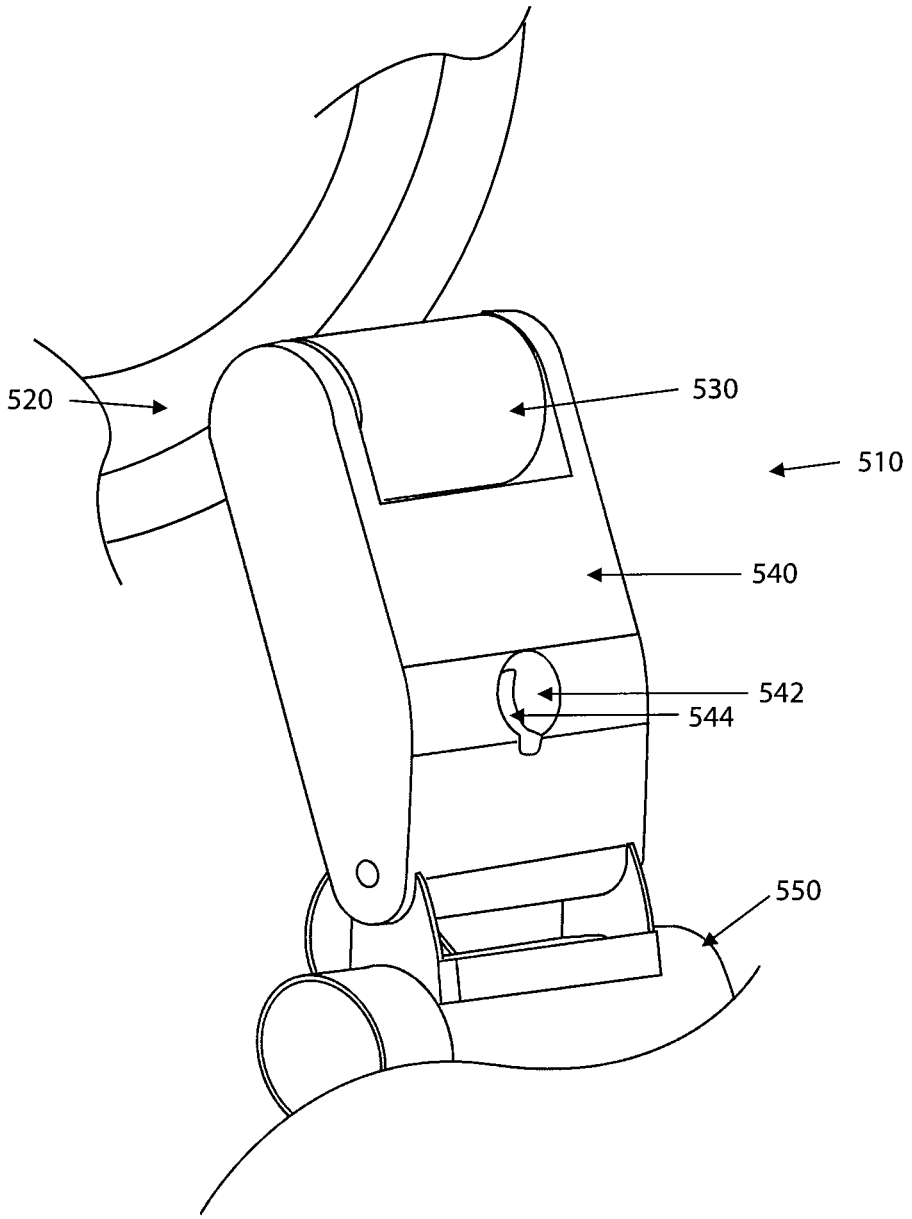
FIG. 11 is an isometric view of the resistance unit of FIG. 10.
Figure 12:
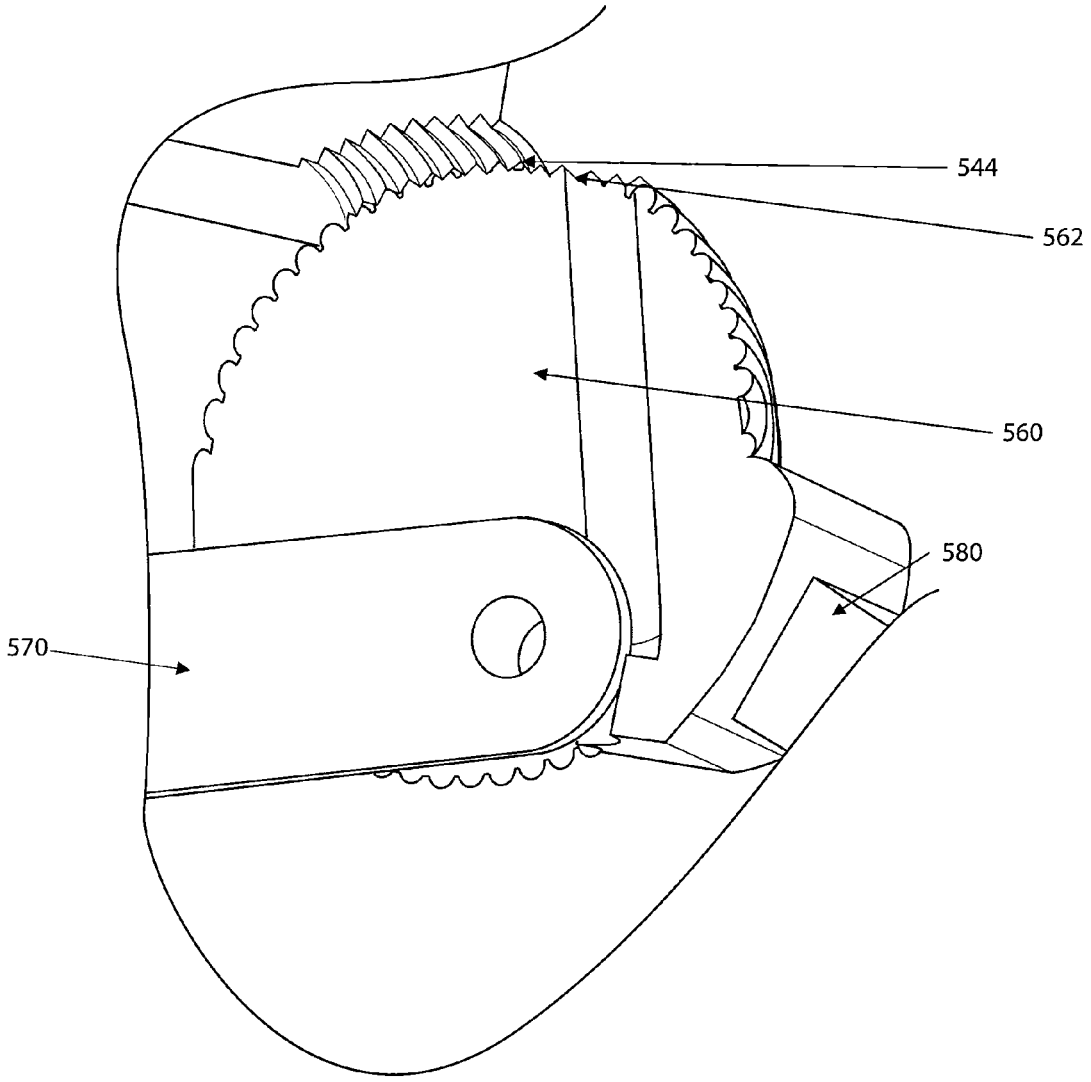
FIG. 12 is a cross-sectional view of a portion of the clutched adjuster of FIG. 10.

Referring to FIG. 10, an embodiment of a clutch lever resistance unit 500 is shown for a bicycle trainer which limits the maximum torque for a predetermined pressure of a movable resistance unit 510 on a bicycle tire 520. The clutch lever resistance unit 500 includes a movable resistance unit 510 that is moved by the clutched adjuster 49, shown here as including a pivoting member which is explained in greater detail elsewhere herein. The movable resistance unit 510 may have a roller 530 for rotationally engaging the bicycle tire 520 in a manner as is known. The roller 530 in turn couples to a body 540 of the movable resistance unit 510, which in turn couples to a support base 550 for providing support from the ground. Referring briefly to FIG. 11, the body 540 of the movable resistance unit 510 includes an opening cavity 542 that may be generally circular in shape. Referring briefly to FIGS. 11 and 12, the opening cavity 542 includes an interior ribbed surface 544.

Referring again to FIG. 10, the clutch lever resistance unit 500 further includes a ribbed cam 560 with an exterior ribbed surface 562. The exterior ribbed surface 562 engages the interior ribbed surface 544 of the opening cavity 542 so as to at least partially define a clutch arrangement. The ribbed cam 560 may take various shapes, including generally spherical, cylindrical or disc-shaped. The ribbed cam 560 may also be coupled, either directly or indirectly, to the support base 550 by a rod 570 extending longitudinally from the ribbed cam 560 to the support base 550 through the ribbed opening cavity 542. The clutch lever resistance unit 500 also includes a manually engageable pivoting member or lever 580 coupled to the ribbed cam 560.

Figure 13:
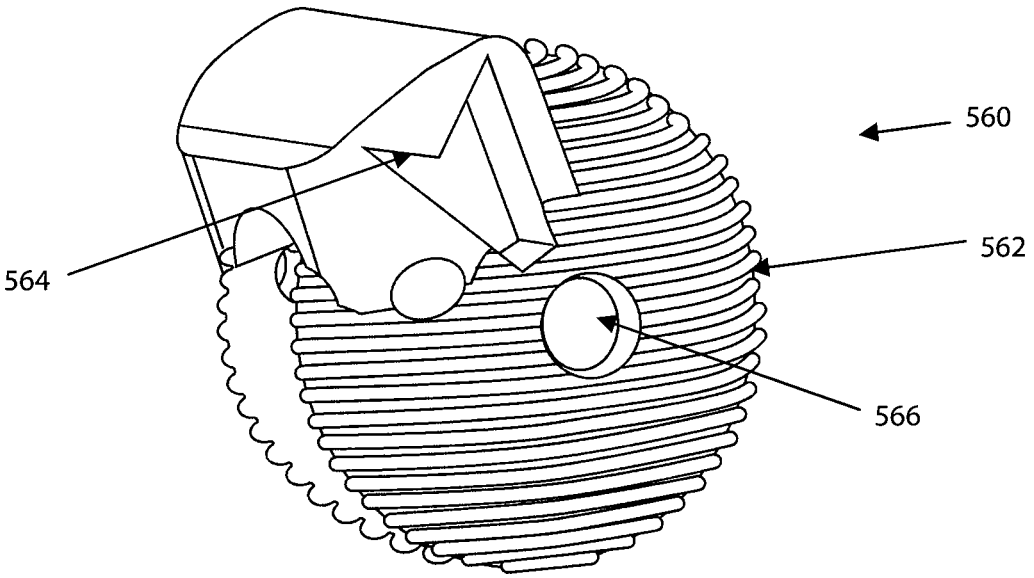
FIG. 13 is an isometric view of a ribbed cam of the clutched adjuster of FIG. 10.

Referring to FIG. 13, the ribbed cam 560 has a detent 564 along one or both of its sides, which may be generally "M" shaped. The ribbed cam 560 also has a receiving point 566 along one or both of its sides for coupling to the lever 580. The receiving point 566 may be off-center from the ribbed cam 560 to allow a greater range of motion and thereby accommodate a greater range of tire sizes.

Figure 14:
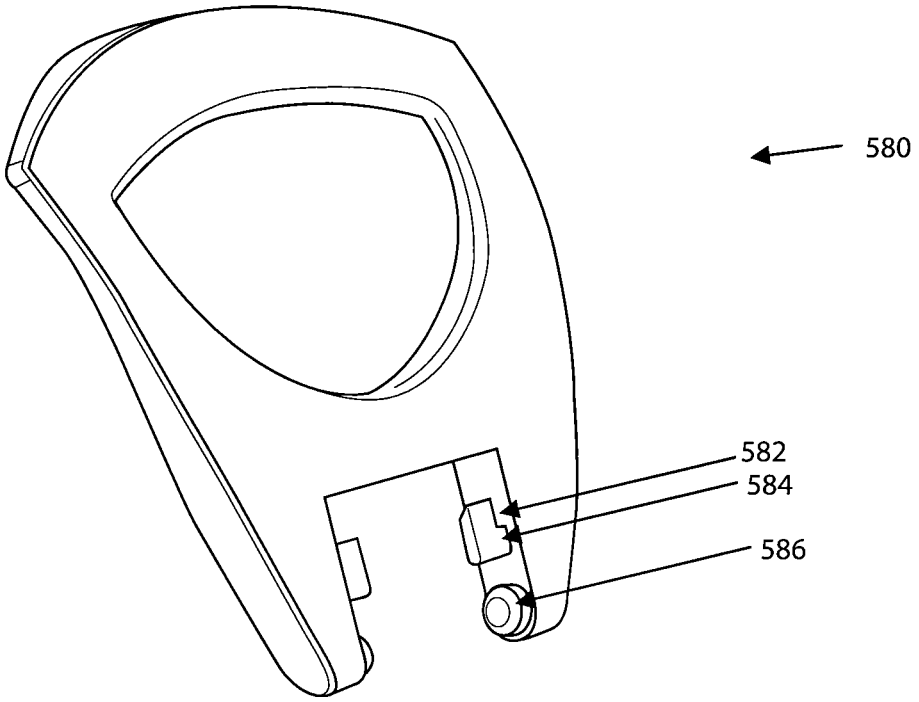
FIG. 14 is an isometric view of the pivoting member of the clutched adjuster of FIG. 10.

Referring to FIG. 14, the lever 580 includes a cantilevered finger 582 with a clutch arrangement 584, along one or both interior sides of the lever 580. The lever 580 also includes a contacting point 586 along one or both interior sides of the lever 580 for coupling the lever 580 to the ribbed cam 560 at the receiving point 566.

Figure 15:
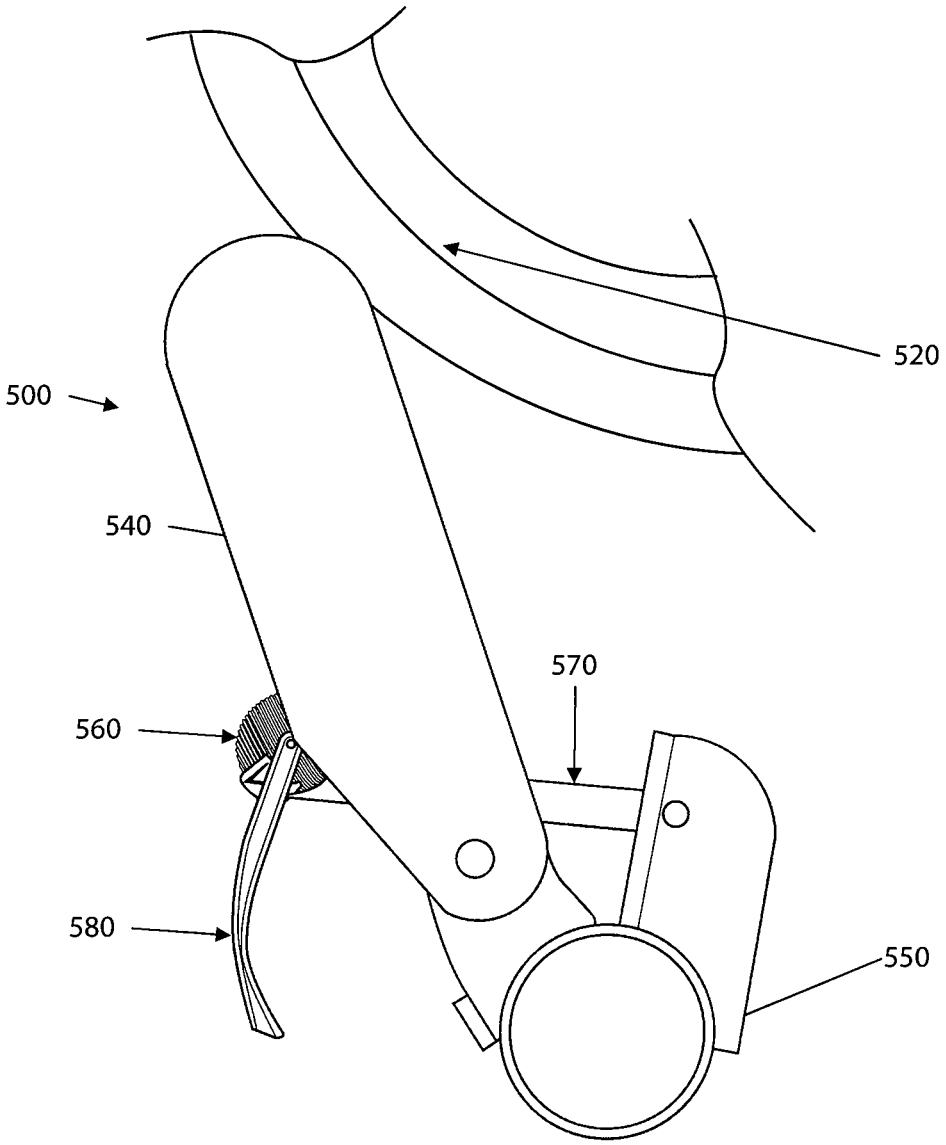
FIG. 15 is a side elevation view of the resistance unit and the clutched adjuster of FIG. 10 in the "open" position and not in contact with a bicycle tire.
Figure 16:
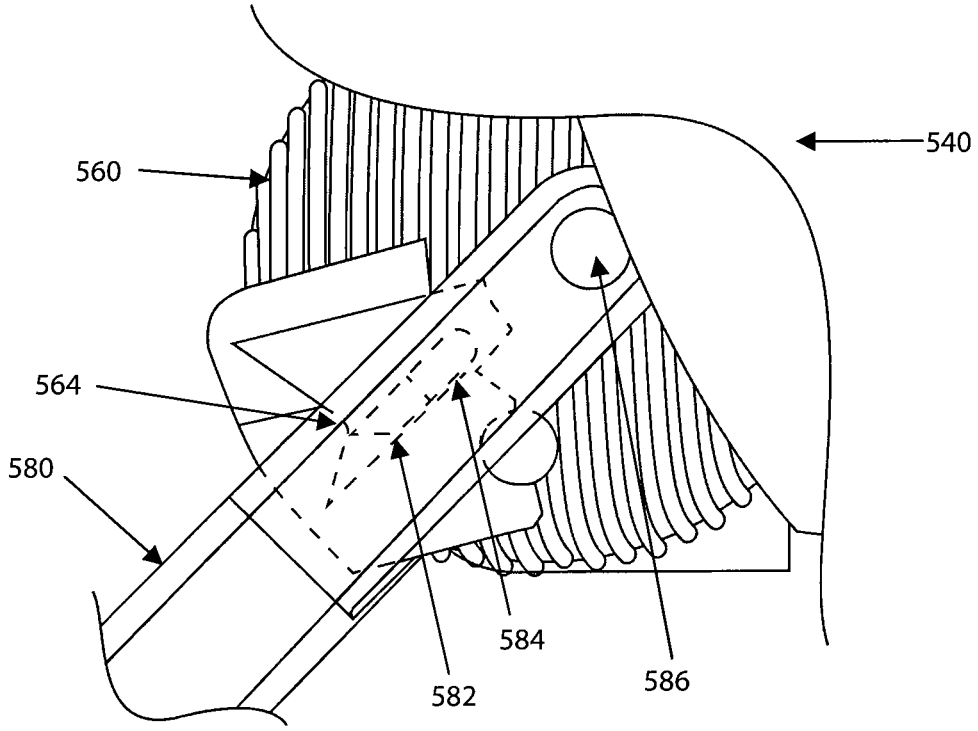
FIG. 16 is a close-up side elevation view of the clutched adjuster of FIG. 10 in the "open" position.

Referring to FIGS. 15 and 16, the clutch lever resistance unit 500 is shown away from the bicycle tire 520 and in an "open" position. The lever 580 is positioned downward, and, as a result, the ribbed cam 560, coupled to the lever 580 and with the cantilevered finger 582 below the detent 564, is also positioned downward such that the resistance unit 500 is moved away from the bicycle tire 520. In the "open" position, the cantilevered finger 582 below the detent 564 causes the ribbed cam 560 to rotate proportionally in response to rotating the lever 580. The clutch lever resistance unit 500 may remain in the "open" position as pressure is applied to the bicycle tire 520 by the resistance unit, until a predetermined maximum pressure is reached.

Figure 17:
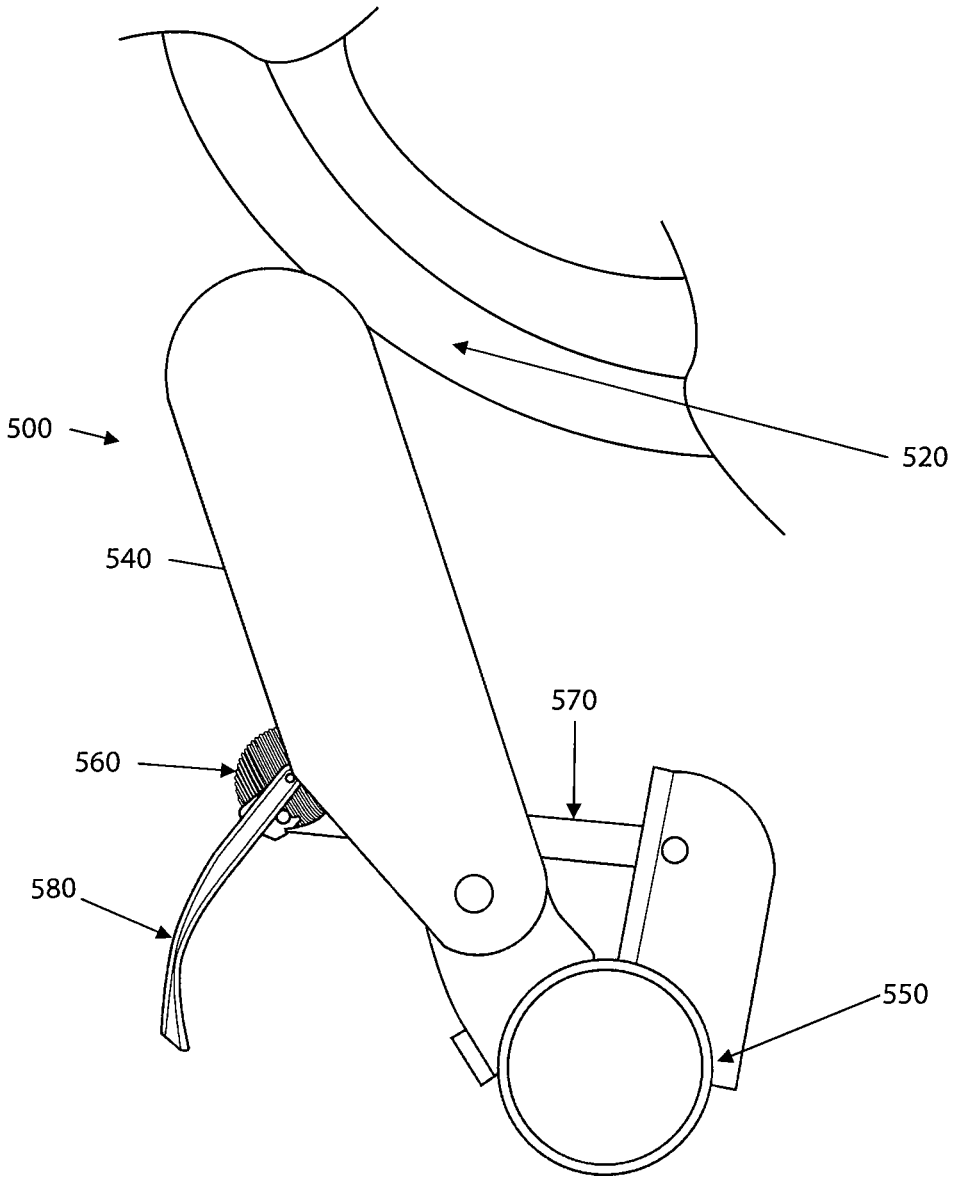
FIG. 17 is a side elevation view of the resistance unit and the clutched adjuster of FIG. 10 in the "closed" position and in contact with a bicycle tire.
Figure 18:
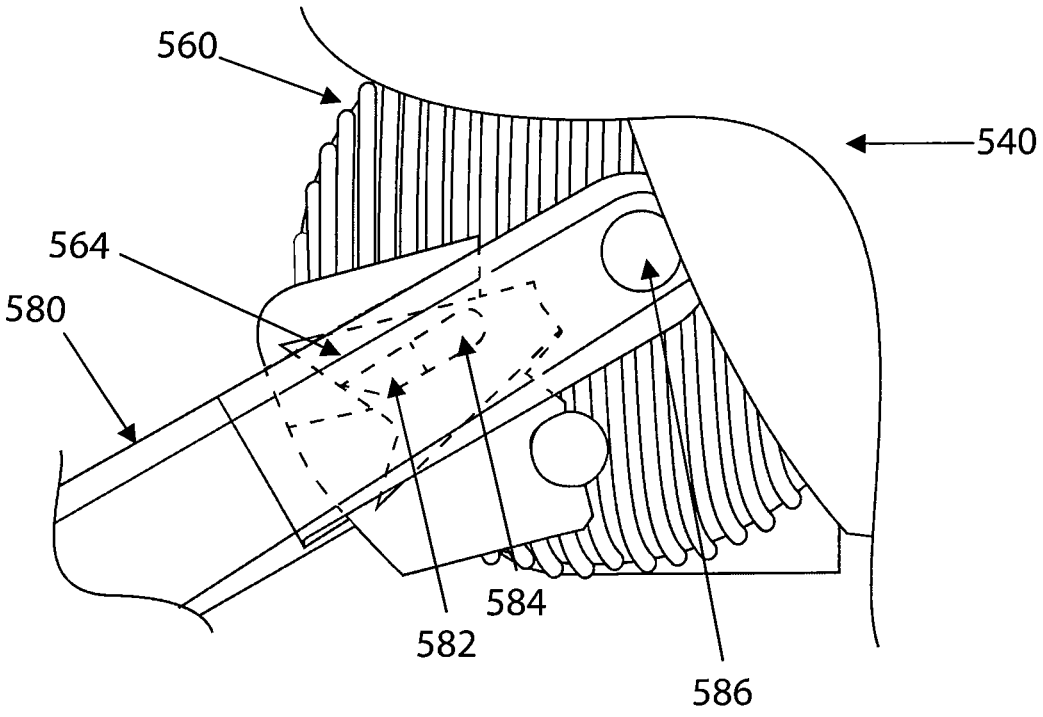
FIG. 18 is a close-up side elevation view of the clutched adjuster of FIG. 10 in the "closed" position.

Referring to FIGS. 17 and 18, the clutch lever resistance unit 500 is now shown in full contact with the bicycle tire 520 and in a "closed" position. In operation, the lever 580 is rotated upward, and, as a result, the ribbed cam 560, coupled to the lever 580 and with the cantilevered finger 582 still below the detent 564 ("open"), is also rotated upward, and the resistance unit 500 is tightened against the bicycle tire 520. Upon a maximum torque for a predetermined pressure of the resistance unit on the bicycle tire being reached, the clutch lever resistance unit 500 then transitions from the "open" position to the "closed" position. During such movement, as lever 580 is moved upwardly, engagement of the finger 582 with the detent 564 moves the resistance unit toward and into engagement with the bicycle tire until a certain desired pressure is attained. Continued movement of lever 580 causes the cantilevered finger 582 to move past the detent 564 which may provide an audible and/or tactile indication that the optimal desired position has been attained. As a result, the clutch arrangement is in the "closed" position which defines a locked position such that any additional upward rotation of the lever 580 will have no effect in moving the ribbed cam 560, and the resistance unit is maintained in the use-ready position without being over tightened.

To loosen the clutch lever resistance unit 500, the lever 580 is again rotated downward, and, as a result, the cantilevered finger 582 moves past the detent 564 to return to the "open" position. Continuing to rotate the lever 580 downward then causes the ribbed cam 560, coupled to the lever 580 and with the cantilevered finger 582 below the detent 564 ("open"), to rotate downward, and the resistance unit 500 to move away from the bicycle tire 520.

Although the best modes contemplated by the inventor of carrying out the present invention are disclosed above, practice of the present invention is not limited thereto. It will be manifest that various additions, modifications and rearrangements of the features of the present invention may be made without deviating from the spirit and scope of the underlying inventive concept. For example, a controlled pressure resistance unit could be enhanced by providing a cam lever used in conjunction with the clutch arrangement to provide faster tightening and loosening of the resistance unit. In addition, a spring could be used in conjunction with the clutch arrangement to provide a more consistent force to the resistance unit when the maximum torque has been applied. Also, a spring could be used without the clutch arrangement to apply a consistent force within a wider range of knob torques.

Furthermore, all of the disclosed features of each disclosed embodiment can be combined with, or substituted for, the disclosed features of every other disclosed embodiment except where such features are mutually exclusive. All of these variations achieve the objectives described herein, which include applying consistent, correct pressure of the resistance unit against the wheel of a bicycle.

What is claimed is:

1. A bicycle trainer, comprising:

a frame that can support a bicycle in a generally stationary position while a user exerts a pedaling effort to rotate a driven wheel of the bicycle;

a resistance unit that is supported by the frame and that cooperates with the driven wheel of the bicycle so as to resist the pedaling effort of the user, the resistance unit being movable toward the driven wheel for tightening the resistance unit so as to apply a pressure from the resistance unit to the driven wheel and away from the driven wheel for loosening the resistance unit so as to release the pressure from the driven wheel; and an engagement mechanism connected between the frame and the resistance unit for selectivity moving the resistance unit toward and away from the driven wheel, wherein the engagement mechanism includes a clutched actuator for moving the resistance unit with respect to the driven wheel, the clutched actuator being operable by a user to selectively place the resistance unit in a disengaged position in which the resistance unit is positioned away from the driven wheel, and in an engaged position in which the resistance unit is moved into engagement with the driven wheel, wherein the clutched actuator includes a clutch arrangement that allows operation of the clutched actuator to place the resistance unit in a maximum tightened position corresponding to a maximum pressure between the resistance unit and the driven wheel, beyond which the clutch arrangement of the clutched actuator prevents further movement of the resistance unit toward the driven wheel.

2. The bicycle trainer of claim 1, wherein the clutched actuator includes a rotatable member that can be rotated to the maximum tightened position, and wherein the rotatable member defines a knob having an upper assembly and a lower assembly that can selectively transmit torque therebetween, and wherein the clutch arrangement is interposed between the upper assembly and the lower assembly.

3. The bicycle trainer of claim 2, wherein the clutch arrangement includes ramps on each of the upper and lower assemblies that engage each other at respective angled surfaces and wherein a spring is arranged between the upper and lower assemblies for biasing the angled surfaces of the ramps of the upper and lower assemblies toward each other.

4. The bicycle trainer of claim 1, wherein the clutched actuator includes a pivoting member that can be pivoted to the maximum tightened position, and wherein pivoting of the pivoting member beyond the maximum tightened position locks the pivoting member into a locked position at which the resistance unit is maintained in the maximum tightened position.

5. The bicycle trainer of claim 1, wherein the clutched actuator provides at least one of a tactile indication and an audible indication when the maximum tightened position has been achieved.

6. A bicycle trainer, comprising:

a frame configured to support a bicycle in a generally stationary position while a user exerts a pedaling effort to rotate a driven wheel of the bicycle;

a resistance unit that is supported by the frame and that cooperates with the driven wheel of the bicycle so as to resist the pedaling effort of the user, the resistance unit being movable relative to the frame toward the driven wheel for tightening the resistance unit so as to apply a pressure from the resistance unit to the driven wheel, and away from the driven wheel for loosening the resistance unit so as to release the pressure from the driven wheel; and a clutched actuator for moving the resistance unit with respect to the driven wheel and including a rotatable member arranged so that rotation of the rotatable member in a first direction moves the resistance unit toward the driven wheel until the rotatable member is rotated to a maximum tightened position corresponding to a use-ready position of the resistance unit wherein, when the rotatable member is rotated to the maximum tightened positioned, 1) the resistance unit applies a maximum pressure to the driven wheel, and 2) further rotation of the rotatable member in the first direction does not cause further movement of the resistance unit toward the driven wheel beyond the use-ready position.

7. The bicycle trainer of claim 6, wherein the rotatable member defines a knob having an upper assembly, a lower assembly and a clutch arrangement that can selectively transmit torque therebetween.

8. The bicycle trainer of claim 7, wherein the upper and lower assemblies are arranged for axial movement with respect to each other, and wherein the clutch arrangement positions the upper and lower assemblies in driving engagement when the upper and lower assemblies are in a first axial position with respect to each other and disengages the upper and lower assemblies from each other when the upper and lower assemblies are in a second axial position with respect to each other.

9. The bicycle trainer of claim 7, wherein the clutch arrangement includes at least one ramp positioned between the upper and lower assemblies such that during an attempted over-tightening procedure, rotational torque applied by a user overcomes a frictional engagement defined at the at least one ramp to provide relative rotation of the upper and lower assemblies with respect to each other.

10. The bicycle trainer of claim 9, wherein the clutch arrangement includes ramps on each of the upper and lower assemblies that engage each other at respective angled surfaces.

11. The bicycle trainer of claim 10, wherein the clutch arrangement includes a spring arranged between the upper and lower assemblies for biasing the angled surfaces of the ramps of the upper and lower assemblies toward each other.

12. The bicycle trainer of claim 10, wherein the lower assembly includes a plate having an upper surface and the upper assembly includes a cap having a lower surface, and wherein the ramps include lower assembly ramps extending from the upper surface of the plate and upper assembly ramps extending from the lower surface of the cap.

13. The bicycle trainer of claim 7, wherein the clutch arrangement includes a spring arm that extends in a generally radial direction between respective portions of the upper and lower assemblies, wherein the spring arm is arranged to deflect for permitting rotation of the upper and lower assemblies with respect to each other during an attempted over-tightening procedure.

14. A bicycle trainer, comprising:

a frame configured to support a bicycle in a generally stationary position while a user exerts a pedaling effort to rotate a driven wheel of the bicycle;

a resistance unit that is supported by the frame and that cooperates with the driven wheel of the bicycle so as to resist the pedaling effort of the user, the resistance unit being movable toward the driven wheel for tightening the resistance unit so as to apply a pressure from the resistance unit to the driven wheel and away from the driven wheel for loosening the resistance unit so as to release the pressure from the driven wheel; and a clutched actuator for moving the resistance unit with respect to the driven wheel and including a pivoting member arranged so that pivoting of the pivoting member in a first direction moves the resistance unit toward the driven wheel until the pivoting member is pivoted to a maximum tightened position corresponding to a use ready position of the resistance unit at which the resistance unit applies a maximum pressure to the driven wheel, and wherein further pivoting of the pivoting member in the first direction beyond the maximum tightened position maintains the resistance unit in the use-ready position without further movement of the resistance unit toward the driven wheel beyond the use-ready position.

15. The bicycle trainer of claim 14, wherein the resistance unit includes a roller supported by a resistance unit body and engaging the driven wheel, the resistance unit body including a cavity that houses a cam arranged between the resistance unit body and the pivoting member for translating movement of the pivoting member into movement of the resistance unit body.

* * * * *